United States Patent [19]

Calvino y Teijeiro

[11] 3,949,182

[45] Apr. 6, 1976

[54] BREAKING CHAMBER FOR SELF-BLASTING COMPRESSED GAS ELECTRIC CIRCUIT-BREAKERS

[75] Inventor: Benito José Calvino y Teijeiro, Bergamo, Italy

[73] Assignee: Magrini Galileo S.p.A., Milan, Italy

[22] Filed: June 14, 1974

[21] Appl. No.: 479,520

[30] Foreign Application Priority Data

June 14, 1973 Italy ..... 50788/73

[52] U.S. Cl. ..... 200/148 R; 200/148 C

[51] Int. Cl.² ..... H01H 33/82

[58] Field of Search ..... 200/148 R, 148 C, 144 R

[56] References Cited

UNITED STATES PATENTS

| | | | |
|---|---|---|---|
| 3,668,352 | 6/1972 | Teijeiro | 200/148 R |
| 3,670,125 | 6/1972 | Teijeiro | 200/148 R |
| 3,708,639 | 1/1973 | Vigreux et al. | 200/148 R |

*Primary Examiner*—Robert S. Macon

*Attorney, Agent, or Firm*—Stevens, Davis, Miller & Mosher

[57] ABSTRACT

An axial blast breaking chamber for self-blasting compressed gas electric circuit breakers wherein the chamber wall is provided with sets of upstream and downstream radial holes having entrances to the inside of the breaker chamber through respective ring-like feeding grooves coaxial to the longitudinal axis of the chamber. When the circuit breaker contacts are closed, the fixed contact, which is in close proximity to the inner wall of the chamber, extends past the feeding grooves thereby inhibiting flow of quenching gas. Flow of quenching gas remains inhibited until the chamber and attached movable contact are displaced sufficiently to withdraw the feeding groove and upstream set of radial holes below the lower end of the fixed contact. The flow is appreciably increased after the downstream set of radial holes is uncovered and interruption of the arc completed as the chamber and movable contact are further separated from the fixed contact.

11 Claims, 5 Drawing Figures

FIG. 4
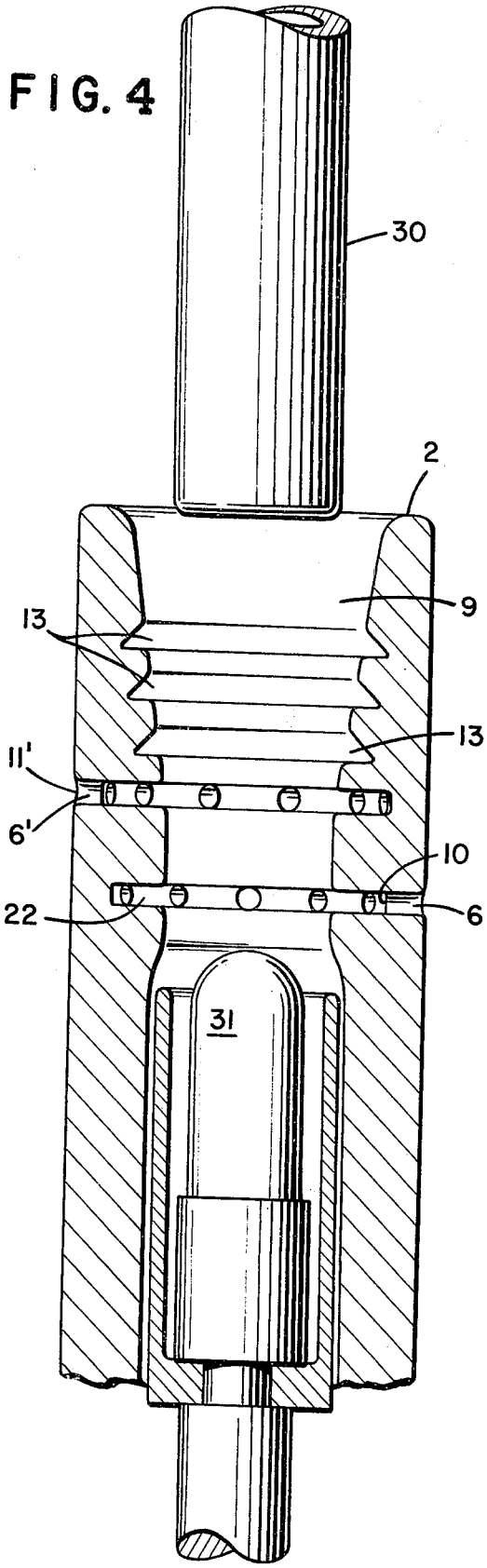
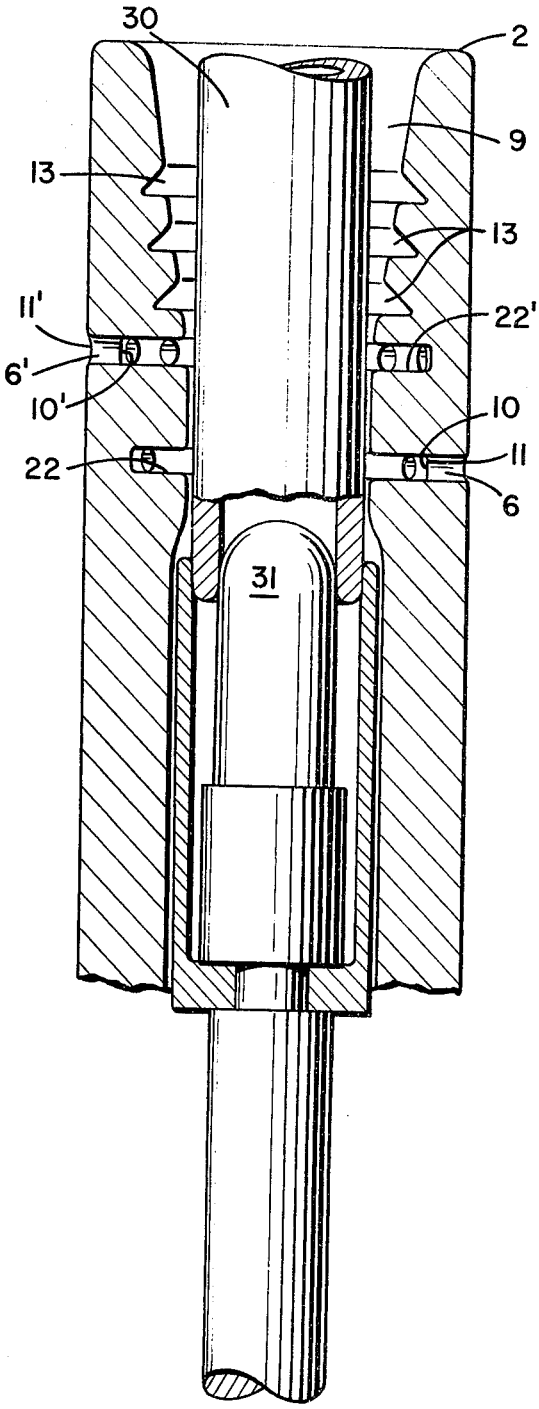
FIG. 3

BREAKING CHAMBER FOR SELF-BLASTING COMPRESSED GAS ELECTRIC CIRCUIT-BREAKERS

BACKGROUND OF THE INVENTION

The present invention relates to a nozzle-shaped structure or breaking chamber for self-blasting compressed gas electric circuit breakers which provide considerably improved performance over prior circuit breakers of the same type.

Self-blasting compressed gas electric circuit breakers are well known and widely employed in electric power generating plants. Axial blast breaking elements for such breakers are particularly well known and a substantial amount of engineering effort has been devoted to the modification and improvement of the nozzle structure (or breaking chamber) of these breakers with the objective of obtaining improved performance. For example, compressed gas circuit breakers having decompression side holes and ring-like grooves in the end zone of the nozzle structure have been developed previously. In these breakers, self-blast of the quenching gas is produced by action of a fixed piston in co-operation with a nozzle structure that is integral with the circuit breaker movable contact. In particular, in circuit breakers of this type, the ratio between the sum of the areas of the smallest sections of the decompression side holes and the area of the smallest flow section (or neck) through the nozzle is equal to 0.5

U.S. Pat. Nos. 3,668,352 granted June 6, 1972, 3,670,125 granted June 13, 1972 and pending U.S. patent application Ser. No. 275,219 filed July 26, 1972, all by the present inventor, disclose nozzle structures for axial self-blasting breaking elements for compressed gas electric circuit breakers which are provided with decompression side holes and ring-like grooves. These holes and grooves are shaped to provide a significant improvement over prior art structures, the decomposition gases developed from the materials making up the nozzle and the quenching gas being caused to flow in a more regular manner. This results in the deionization of the insulating medium and dielectric strength recovery being substantially improved.

The design of the downstream (or end) zone of nozzles of the type disclosed in the previously mentioned U.S. Patent Nos. and patent application is dependent on the rated service voltage of the circuit-breaker according to the formula $$L \geqslant \frac{U_n}{\sqrt{3}}(1.5)\ \sqrt{2},$$

where L is the length of the nozzle end zone, in mm, and $U_n$ is the circuit-breaker service rated voltage, in kV.

This experimental relationship can be started in the following form:

$$\frac{L}{\frac{1.5\ \sqrt{2}}{\sqrt{3}}U_n} \geqslant 1 \text{ (in mm/}kV\text{)},$$

where $1.5\ (\sqrt{2}/\sqrt{3})\ U_n$, in kV represents the effective value of the recovery voltage occurring at the ends of that pair of contacts which first interrupts the current.

It has been found, however, that existing breakers do not have optimum efficiency, particularly with regard to the outflow of the arc quenching gas as well as the outflow of the decomposition gases developed from the materials making up the nozzle. Further, rapid and effective deionization of both the electric arc plasma and the surrounding space (that is, the inner part of the nozzle where the movable contact separates from the fixed contact) have not been attained in axial blast breaking elements provided with nozzle structures developed heretofore.

SUMMARY OF THE INVENTION

The present invention, which improves the performance of circuit breakers of this type, is provided with two sets of decompression holes machined through the portion of the nozzle wall corresponding to the cylindrical zone having the smallest cross-section. The axes of the holes in each set are angularly offset with respect to the axes of the holes in the other set, and the ratio of the sum of the areas of the smallest section of the decompression side holes to the area of the smallest flow section through the nozzle is equal to or greater than 0.75. The use of two hole sets not only improves decompression inside the nozzle but also increases the plasma deionizing effect. This effect appears primarily at the two distinct portions of the arc body corresponding to the two sets of holes although it also influences the entire arc.

The particular design of the breaking chamber which is the subject of this invention also improves the dielectric strength recovery of the medium interposed between the contacts by increasing the speed of recovery. As a result, the capacity of the medium to withstand the recovery voltages is increased, particularly when the recovery voltage follows a trend characterized by short down times and particularly high initial values of the accretion speed. These properties are very important in providing high breaking capacities to the circuit breakers under any of the fault conditions which can occur in electric power systems. Indeed, it has been found surprisingly that the existence of two sets of holes, besides increasing the decompression effect, advantageously influences both the arc plasma deionization and recovery of the dielectric strength of the insulating and quenching medium.

An object of this invention is to obtain a nozzle structure for self-blasting compressed gas electric circuit breakers having a particularly improved shape and qualitative performance which is very high in comparison with that obtained from prior art equipment, including the breaking chambers disclosed previously by the present inventor.

Another object of the invention is to provide an improved structure wherein gas flow through the breaking chamber increases at the same time as the decompression effect inside the chamber increases. Further, and of greater importance, a significant improvement is obtained in the deionizating effect of the arc plasma together with the recovery effect of the dielectric strength of the medium interposed between the contacts. These advantages are obtained without prejudice to, but to the contrary, together with an improvement in the flow of the decomposition gases developed from the breaking chamber materials and the quenching gas, particularly with regard to the end (or downstream) zone of the breaking chamber wherein the ring-like grooves are located.

These and further objects, which will be better understood from the following detailed description, are obtained by a novel axial blast nozzle structure for self-blasting compressed gas electric circuit breakers. This nozzle structure is substantially cylindrical and has an outlet orifice at one end and an inlet orifice at the other end. The inside of the nozzle, proceding toward the nozzle outlet, comprises a first zone which is both conical and convergent, a second cylindrical zone having the smallest cross-section with respect to the other nozzle internal zones and a third zone which is substantially conical and divergent.

The third zone has a length determined by the experimental relation $$L \geqslant \frac{U_n}{\sqrt{3}}(1.5)\sqrt{2},$$

and is located between the outlet end of the cylinder and the second zone. The third conical and divergent zone is provided with a plurality of annular grooves, each having a diametrical section which is substantially triangularly shaped with an open base facing the outlet orifice of the nozzle structure.

The second zone, which is cylindrical and of the smallest cross-section of the three zones has a plurality of outlet and decompression side means machined in the shape of holes which pass through the nozzle wall and are grouped in first and second distinct sets respectively placed at the upstream and downstream ends, with respect to the gas outflow direction, of the second zone. The axes of the holes of the first set are offset with respect to the axes of the holes of the second set. The mouths or inlet sections of the first and second sets of holes are connected by means of respective first and second annular feeding grooves co-axial to the nozzle structure. The ratio of the sum of the areas of the smallest cross sections of the outflow and decompression side holes to the area of the smallest flow section (or neck) of the nozzle, constituted by the cylindrical zone, is equal to or greater than 0.75.

BRIEF DESCRIPTION OF THE DRAWINGS

FIG. 3 illustrates the breaking chamber of FIG. 1 with the breaker contacts in the closed position.

FIG. 4 shows the breaking chamber with the contacts in the open position.

DESCRIPTION OF THE PREFERRED EMBODIMENTS

Figure 1:
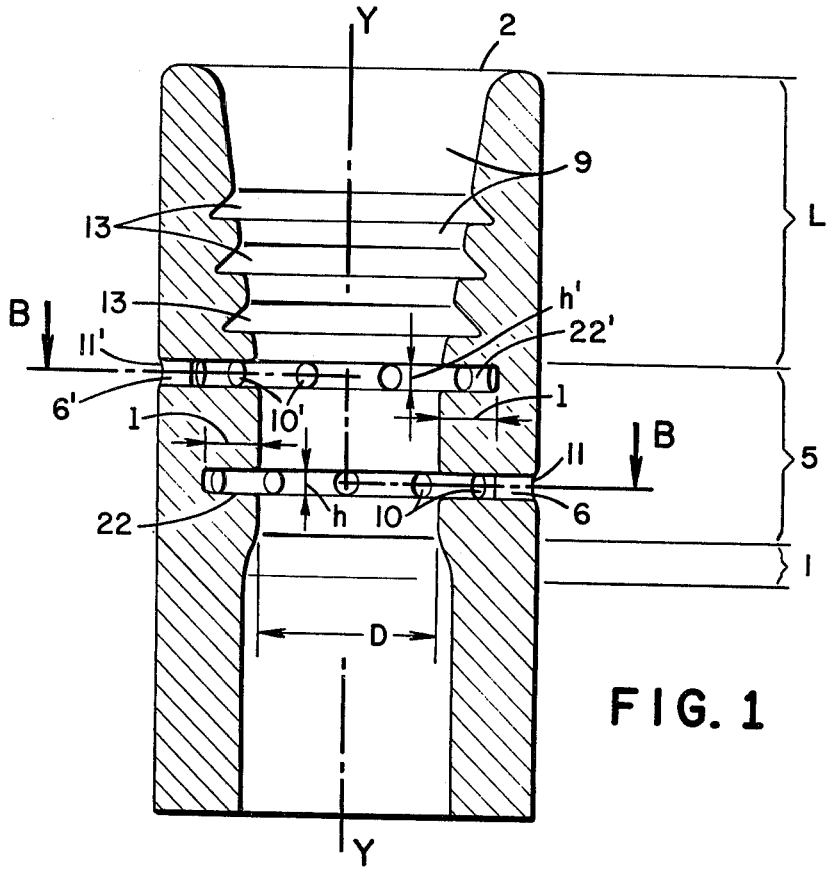
FIG. 1 schematically shows a longitudinal section of the nozzle drawn along broken line A—A of FIG. 2, i.e., along two different axial planes.

Referring to FIGS. 1 and 2 which show the nozzle structure or breaking chamber of the self-blasting compressed gas electric circuit-breaker, the chamber, which is shaped in accordance with the Venturi tube principle, has a substantially conical and convergent first zone 1, a substantially conical and divergent third zone 9 and a second (or neck) zone 5 which has a cross-section of smallest area with respect to the cross-sections of the other nozzle zones. The second zone 5 is cylindrical and is provided with a plurality of decompression holes for allowing the interior of the chamber to communicate with the space outside the nozzle. The holes have relatively small diameters when compared with those normally provided in breaker chambers of this type in order to allow more holes to be distributed about the longitudinal axis Y—Y of the breaker.

Figure 2A:
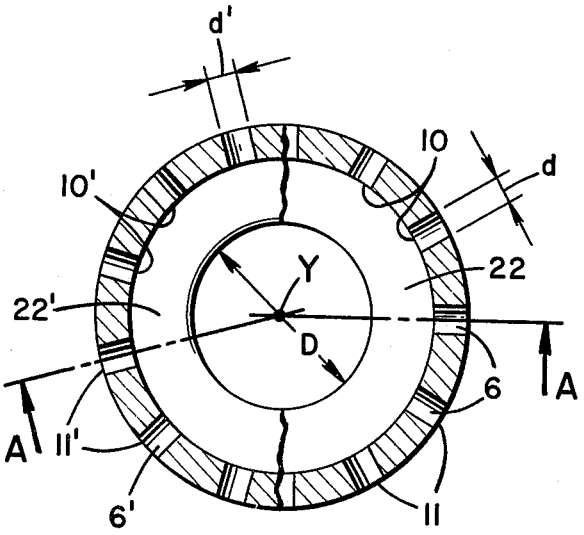
FIG. 2*a* is a schematic cross-section drawn along the broken line B—B of FIG. 1, through the longitudinal axis of the nozzle in two different transverse planes
Figure 2B:
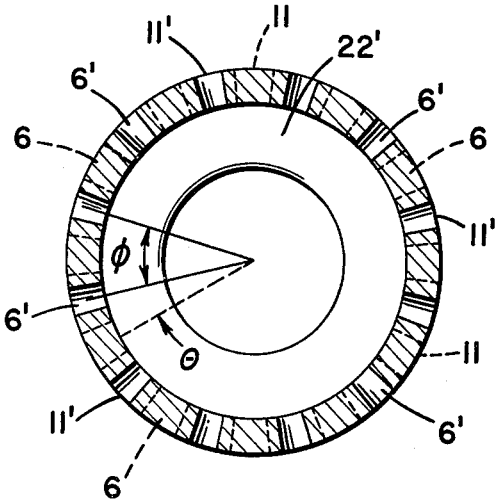
FIG. 2*b* is a schematic cross-section showing another embodiment of the invention together with the angular relation between the axes of the first and second sets of holes of FIGS. 1 and 2*a*.

A first set of circular lateral holes 6 is provided at the upstream end of the cylindrical zone 5 and a second set of circular lateral holes 6' is located at the downstream end of the zone 5. Preferably there are the same number of holes in each of the two sets and each set has the radial axes of its holes lying respectively in a corresponding plane perpendicular to the nozzle axis Y—Y and therefore parallel to the plane of the radial axes of the holes of the other set. The axes of the holes in one set are offset with respect to the corresponding holes of the other set by an angle $\theta$ equal to $360/2n$ degrees, where $n$ is the number of holes included in each set. In FIGS. 2*a* and 2*b*, $n$ is equal to 12; therefore the 12 holes in the first set are offset from those in the second set by an angle $\theta$ equal to 15°. Preferably, the holes within each set are displaced from each other by the same angle $\phi$ which in FIG. 2*b* is 30°.

The holes 6 and 6' of the two sets are connected by first and second annular grooves 22 and 22' respectively formed in the inner wall of the cylindrical zone 5. These grooves act as rings or channels which connect all of the decompression holes of their respective sets. The section of each groove drawn in a nozzle axial plane is substantially rectangular, $h$ and $h'$ representing the heights of grooves 22 and 22' respectively and $l$ and $l'$ the depth of grooves 22 and 22' respectively. The mouth or inlet sections 10 and 10' of holes 6 and 6' facing the bottom of the respective annular feeding grooves 22 and 22' inside the breaking chamber are substantially parallel to the longitudinal axis Y—Y of the chamber because of the shape of their respective annular feeding grooves 22 and 22'. The holes 6 and 6' pass entirely through the nozzle wall with outlets designated as 11 and 11' respectively in FIGS. 1, 2*a* and 2*b*.

The third zone 9, which is divergent and has a truncated cone form, is provided with annular grooves 13. The diametrical sections of these grooves are triangularly shaped and the open bases face the chamber outlet orifice 2.

Referring to FIGS. 3 and 4, fixed contact 30 and movable contact 31 are shown positioned within the nozzle, movable contact 31 being secured to and moving with the nozzle. When the circuit breaker is closed, (FIG. 3), the fixed contact 30 occupies a large portion of the space within the breaking chamber extending through the third zone 9 and second zone 5 as well as a substantial portion of the first zone 1. It is also desirable in some designs to have the fixed contact extending entirely into and across the first zone 1. Under these static conditions, the gaseous quenching fluid within the chamber cannot circulate.

When the opening operation is begun and self-blasting consequently initiated, the fixed contact 30 remains in zone 1 and obstructs zone 5 almost entirely since the contact 30 is cylindrical and its outer diameter not much smaller than the inner diameter of zone 5. In addition, an electric arc, which strikes as soon as the contacts 30 and 31 part, is present and fills substantially the entire space between the contacts as well as between the contacts and the inner wall of the nozzle. Further, owing to thermal expansion involving the insulating and quenching medium interposed between the contacts, a back pressure is produced within zone 5 and consequently the quenching gas outflow is substantially hindered. This is true even when now, notwithstanding the fact that the opening operation has begun and therefore static conditions no longer exist because, even under such conditions, only a very small and entirely neglectable quantity of gas succeeds in escaping through the clearance between the fixed contact 30 and the inner wall of zone 5 since this clearance is extremely small.

As the opening operation continues the contacts 30 and 31 are driven apart. The fixed contact 30 no longer blocks the first or upstream annular feeding grooves 22 and its holes 6. At this moment, the gas outflow created by the self-blast as well as the outflow of the gases developed by decomposition of the nozzle materials due to the high temperature produced by the arc is taking place, at least partially, through the upstream annular feeding groove 22 and holes 6. The total area of the outlet section corresponds at this instant to the sum of the areas of the smallest cross-section of each of the holes 6.

Subsequently, the fixed contact 30 uncovers downstream annular feeding groove 22' with its corresponding holes 6'. The outflow of the gases is then appreciably increased since it can take place through both annular feeding grooves 22 and 22' and both sets of holes 6 and 6'. The area of the total outlet section is then equal to the sum of the areas of the smallest cross-section of each of the holes 6 and 6'.

As the opening operation continues, fixed contact 30 leaves the second zone 5 and reaches the lower end of zone 9. The ports of this latter zone have a substantially circular crown shape since they are defined by the fixed contact 30 and the inner wall of zone 9. These ports now conduct the outflow of the mixture of the quenching gas and decomposition gases. The quenching gas, forced through the nozzle by the self-blast, then totally runs over the arc body and completes the deionization action on the arc plasma. This gas later bursts out of the nozzle through the outlet orifice 2 of the nozzle itself.

When the arc has been quenched, the recovery voltage appears between the contacts. It is necessary to prevent the arc from restriking and in order to do this it is necessary to restore the dielectric strength in as positive, rapid and effective a manner as possible. This is precisely the result obtained by the use of the two sets of holes 6 and 6'. More specifically, the use of the second downstream set of holes 6' surprisingly provides a remarkable increase in the breaking capacity (or breaking power) of the circuit breaker. This is due to improved deionization action within the nozzle, particularly within the narrow neck zone 5. The combined use of the annular feeding grooves 22 and 22', which equalize and regularize the gas flow through holes 6 and 6' is extremely important.

In order to avoid misunderstandings, it is specified that the terms "upstream" and "downstream" refer to the outflow direction of the quenching gas, regardless of the position of the nozzle. Consequently, since the gas flows from zone 1 toward zone 9, the set of holes 6 has been defined as the upstream set and the set of holes 6' has been specified as the downstream set.

The evenness of the gas flow is very important, both with respect to decompression and to deionization, and this invention provides another advantageous feature in the offset arrangement of the hole axes of the first set with respect to the hole axes of the second set. The example shown in FIGS. 1, 2*a* and 2*b* employ first and second sets each having twelve holes. The holes 6 of the first set are identical, symmetrically arranged, and angularly displaced with respect to each other by 30°. Similarly, the holes 6' of the second set are identical, symmetrically arranged, and also angularly displaced by 30°.

On the other hand, referring to FIG. 2*b*, the axes of each hole 6 with respect to the axis of a corresponding hole 6' is angularly offset from the axis of the hole 6' by ½(30°) or 15°. Thus, as is clear from FIG. 2*b*, the holes 6 of the first set are symmetrically interleaved with the holes 6' of the second set thereby providing excellent regularity for the radial (or lateral) outflow of the gases from the nozzle, with consequent further decrease of the turbulence in the gas mass within the nozzle itself. The number of holes included in each set, although shown as 12 in the specific example described above, can vary from 6 as a minimum to 12 or more. If less than six holes are used there is no improvement in the circuit breaker performance; more than twelve holes can be employed but the construction must be compatible with the mechanical design of the breaker and consequently with the nozzle dimensions (taking into consideration the rated service voltage $U_n$) as well as the diameter of the holes.

The material forming the nozzle structure is chosen from those which do not produce carbon or other electrically conducting products when exposed to the high temperatures produced by the electric arc with which the materials come into contact. A preferred material is polytetrafluoroethylene, (in particular, forms of this material known by the trademarks Teflon and Algoflon) and this is especially true when sulpher hexafluoride gas ($SF_6$) is used as the insulating and quenching means. The use of polytetrafluoroethylene and sulphur hexafluoride gas does not constitute a part of this invention since both materials are well-known for use in such applications.

As previously stated, the ratio between the sum of the smallest cross-sectional areas of holes 6 and 6' to the area of the smallest flow-section through the nozzle found in cylindrical zone 5 must have a value which is not less than 0.75. For example if $d = d' = 5.5$mm, $n = 12$ for each set of holes, and the diameter $D = 30$ mm, the ratio corresponds to:

$$2nd^2/D^2 = (2)(12)(5.5)^2/(30)^2 = 0.8$$

The advantages obtained by the particular shape of the chamber in the zone 9 having a length L and annular grooves 13 with triangular shape has been described in detail in applicants' previously mentioned patents. These advantages combine with those of the present invention to produce a substantially improved nozzle structure. Further, the presence of annular grooves 22 and 22' machined in zone 5 either have no effect or are somewhat helpful in influencing the uniformity of the gas flow.

The annular feeding grooves 22 and 22', which preferably have a rectangular section as shown in the drawings, may also be triangular, trapezoidal or semicircular or have other suitable shapes. With respect to the holes 6 and 6' they may also have forms and dimensions other than those already described. One alternative, which is particularly important, employs holes 6 in the first set having diameters different from those of the holes in the second set. For example, as shown in FIG. 2*b*, the holes of the upstream set 6 may have a diameter *d* which is higher than the diameter *d'* of the holes belonging to the downstream set. This feature is significant in increasing the decompression and deionization effects which take place as soon as the fixed contact 30 no longer covers the first set of holes 6. In addition the holes of both sets, instead of having a cylindrical form can have a conical and divergent configuration (FIG. 2*b*) or can be structured according to the Venturi tube principle. Further in addition to, or independent of this modification, each of the holes can have its axis inclined with respect to the longitudinal axis Y—Y rather than lying within a plane perpendicular to the chamber axis. For example, the axis of the holes can tilt toward the outlet orifice 2 of the chamber thereby making an angle less than 90° with the axis Y—Y to improve further the gas outflow. Moreover, it is within the scope of the invention for the two sets of holes 6 and 6' to have the axes of the respective holes offset among themselves by angles different from 360/2*n*. The limiting value is zero (or its equivalent 360/*n*) when each hole 6 of the first set has its axis on the same generatrix of an ideal cylinder on which the axis of a corresponding hole 6' of the second set is incident.

What is claimed is:

1. In an axial blast breaking chamber for self-blasting compressed gas electric circuit breakers having fixed and movable contacts, a blast nozzle internally shaped to provide, in the outlet direction, a first conical and convergent zone, a second cylindrical zone and a third substantially conical and divergent zone having a length L equal to or greater than $$\frac{U_n}{\sqrt{3}}(1.5)\sqrt{2};$$

wherein $U_n$ is the rated service voltage of said circuit breaker, said second zone having a cross-sectional area not greater than that of said first and second zones, and said third zone having a plurality of ring-like grooves each of which has a substantially triangular cross-section within a plane passing through the longitudinal axis of the chamber, said ring-like grooves being open toward the outlet orifice of the breaking chamber, wherein the improvement comprises having a first set of lateral outlet holes through the upstream end of the chamber wall corresponding to said second smallest cross-sectioned cylindrical zone, and a second set of lateral outlet holes through the downstream end, with respect to the gas outflow direction, of the chamber wall corresponding to said second smallest cross-sectioned cylindrical zone, the axes of the first set of outlet holes being angularly offset with respect to the axes of the second set of outlet holes; said first set of outlet holes being connected by a first annular feeding groove coaxial to the longitudinal axis of the breaking chamber and the entrances within said breaking chamber of said second set of outlet holes being connected by a second annular feeding groove coaxial to said longitudinal axis, the ratio of the sum of the smallest cross-sectional areas of said first and second sets of outlet holes to the cross-sectional area of said second zone being not less than 0.75.

2. An axial blast breaking chamber as defined in claim 1 wherein there is an equal number of first and second lateral outlet holes and wherein the number of holes in each set is at least six, the holes in each set being angularly equidistant from each other.

3. An axial blast breaking chamber as defined by claim 2 wherein there are 12 holes in each of said first and second sets of lateral outlet holes.

4. An axial blast breaking chamber as defined by claim 1 wherein the holes in each of said first and second sets are of circular cross-section and have radial axes, the axes of the holes in said first and second sets lying within respective first and second planes perpendicular to said longitudinal axis.

5. An axial blast breaking chamber as defined by claim 1 wherein the angle of offset between the axis of a hole of said first set and the axis of an adjacent hole of said second set is between zero and 360/*n* degrees, wherein *n* is the number of holes in each set.

6. An axial blast breaking chamber as defined by claim 5 wherein said angle of offset is 360/2*n* degrees.

7. An axial blast breaking chamber as defined by claim 1 wherein the holes of said first and second sets have divergent conical shapes and their axes are inclined, with respect to said longitudinal axis, by an angle less than 90° toward the outlet orifice of said breaking chamber.

8. An axial blast breaking chamber as defined by claim 1 wherein the diameter of the holes of said first upstream set is greater than the diameter of the holes of said second downstream set.

9. An axial blast breaking chamber as defined by claim 1 wherein said first and second annular feeding grooves have substantially rectangular sections, the height of each of said grooves being at least equal to the diameter of the holes connected by said groove.

10. An axial blast breaking chamber as defined by claim 1 wherein said breaking chamber is made of polytetrafluorethylene.

11. An axial blast breaking chamber as defined by claim 1 wherein sulphur hexafluoride is enclosed within said chamber for arc quenching.

* * * * *